US007922377B2

(12) United States Patent
Yamamichi et al.

(10) Patent No.: US 7,922,377 B2
(45) Date of Patent: Apr. 12, 2011

(54) VEHICLE LAMP

(75) Inventors: Tatsuhiko Yamamichi, Shizuoka (JP); Shigeyuki Watanabe, Shizuoka (JP); Tetsuaki Inaba, Shizuoka (JP); Takashi Inoue, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/805,544

(22) Filed: May 23, 2007

(65) Prior Publication Data

US 2007/0279927 A1 Dec. 6, 2007

(30) Foreign Application Priority Data

Jun. 2, 2006 (JP) ..... 2006-154878

(51) Int. Cl.
*F21S 8/10* (2006.01)

(52) U.S. Cl. ..... 362/545; 362/475; 362/476; 362/507; 362/546; 362/548; 362/538; 362/544; 362/547; 362/549

(58) Field of Classification Search ..... 362/473, 362/475, 476, 507, 545, 546, 548, 549, 294, 362/538, 544, 547, 441, 446
See application file for complete search history.

(56) References Cited

U.S. PATENT DOCUMENTS

2004/0085779 A1* 5/2004 Pond et al. ..... 362/516
2004/0202007 A1* 10/2004 Yagi et al. ..... 362/545
2005/0094414 A1* 5/2005 Ishida et al. ..... 362/545
2005/0122736 A1* 6/2005 Watanabe et al. ..... 362/542
2005/0141235 A1* 6/2005 Takeda et al. ..... 362/545
2005/0237758 A1* 10/2005 Takeda et al. ..... 362/512
2007/0091632 A1* 4/2007 Glovatsky et al. ..... 362/547

FOREIGN PATENT DOCUMENTS

JP 57-158101 10/1982
JP 2004-311224 11/2004
JP 2005-141919 6/2005

OTHER PUBLICATIONS

Patent Abstracts of Japan, Publication No. 2004-311224, Publication Date: Nov. 4, 2004, 2 pages.
Notice of Reason of Rejection in Patent Application No. 2006-154878, mailed Sep. 2, 2010, and English translation thereof, 4 pages.

* cited by examiner

*Primary Examiner* — Sandra L O Shea
*Assistant Examiner* — Mary Zettl
(74) *Attorney, Agent, or Firm* — Osha • Liang LLP

(57) ABSTRACT

A vehicle lamp includes a light emitting diode (LED) unit supported by a metal-made support member. The LED unit is constituted by an integrally formed aluminum diecast product including an LED support portion for supporting an LED, a reflector including a reflecting face constituted by a face thereof opposed to the LED, a rib projected from a back face of the reflector, and a connecting portion connected to the metal-made support member.

10 Claims, 4 Drawing Sheets

VEHICLE LAMP

This application claims foreign priority from Japanese Patent Application No. 2006-154878, filed on Jun. 2, 2006, the entire contents of which are hereby incorporated by reference.

BACKGROUND OF THE INVENTION

1. Field of the Invention

The present invention generally relates to a vehicle lamp. Specifically, the invention relates to a technology of effectively discharging heat in a vehicle lamp using a light emitting diode (hereinafter referred to as an "LED") as a light source.

2. Related Art

Although an incandescent bulb, such as a halogen bulb or the like, a discharge bulb, or the like have been used as a light source in a vehicle lamps, according to the light source of the background art, the light source has a certain constant size requirement, which is accompanied by heat generation. Therefore, there is a limit in how small-sized the lamp can be formed.

Accordingly, there has been proposed a trial of downsizing a lamp by constituting a light source by a semiconductor light emitting element near to an ideal point light source and having a small heat generation amount.

In one case of a light source constituted by an LED, there is a trial of forming an LED unit for irradiating a desired pattern by one piece or an extremely small number of LEDs and a light control member for controlling light from the LED. There are several kinds of LED units for irradiating different patterns arranged at one lamp, and a beam of the desired pattern is irradiating by synthesizing the patterns irradiated from the plurality of LED units. This is possible because pattern design is comparatively easy because the LED is near to an ideal point light source.

However, when the one lamp is constituted by the above-described plurality of LED units, each of the LED units needs to be a small size. Therefore, even in the case of the LED having only a small heat generation amount in comparison with that of other light sources, such as an incandescent bulb or the like, when the LED is confined in a narrow space, the amount of heat accumulated in the space cannot be disregarded.

Patent Reference 1 shows that a plurality of lamp units each constituting a light source by LEDs (LED units) are supported by a common metal-made support member, and heat generated in accordance with lighting the LEDs is discharged by way of the metal-made support member.

[Patent Reference 1] JP-A-2004-311224

However, according to the vehicle lamp shown in Patent Reference 1, discharge of the heat of the LED is not sufficient.

SUMMARY OF THE INVENTION

One or more embodiments of the invention effectively discharge the heat of the LED in a vehicle lamp using an LED unit.

According to one or more embodiments of the invention, there is provided a vehicle lamp having an LED unit supported by a metal-made support member, wherein the LED unit is constituted by integrally forming an LED support portion supporting the LED, a reflector constituting a reflecting face by a face thereof opposed to the LED, a rib projected from a back face of the reflector, and a connecting portion connected to the metal-made support member as an aluminum diecast product.

Therefore, according to the vehicle lamp in accordance with one or more embodiments of the invention, the heat of the LED is conducted from the LED support portion to the metal-made support member by way of the reflector and the connecting portion to be discharged swiftly. Further, heat conducted to the reflector is conducted to the connecting portion by way of the rib projected from the back face and is discharged into air (inside the lamp) from the rib. Therefore, the heat of LED does not stay at the site of the LED, and it can be avoided that a temperature of the LED is elevated by the heat of lighting the LED, which can lead to the impairing of a function thereof.

In one or more embodiments of the invention, a vehicle lamp has a light emitting diode unit supported by a metal-made support member, wherein the LED unit is constituted by integrally forming an LED support portion supporting the LED, a reflector constituting a reflecting face by a face thereof opposed to the LED, a rib projected from a back face of the reflector, and a connecting portion connected to the metal-made support member as an aluminum diecast product.

Therefore, in the vehicle lamp according to one or more embodiments of the invention, heat of the LED is conducted from the LED support portion to the metal-made support member by way of the reflector and the connecting portion, and is swiftly discharged. Further, the heat conducted to the reflector is conducted to the connecting portion by way of the rib projected from the back face and is discharged into air (inside the lamp) from the rib. Therefore, the heat of LED does not stay at the site of the LED, and it can be avoided that the temperature of the LED is elevated by the heat of lighting the LED, which can lead to impairing of the function thereof. Further, because the reflector and the connecting portion are connected by the rib, the reflector and the connecting portion are reinforced, and a shape stability is promoted. Also, the shape of the reflecting face of the reflector can accurately be formed, and a desired light distribution function can be achieved.

According to one or more embodiments of the invention, the LED support portion includes a mounting face supporting an LED board mounted with the LED in a direction in which an optical axis of the LED becomes orthogonal to an emitting light axis of the LED unit and brought into face contact with a back face of the LED board, the reflecting face of the reflector covers a front side in an irradiating direction of the LED and reflects light from the LED to a front side of the LED unit, the connecting portion includes a contact face extended substantially in a vertical direction to be disposed on a back side of the reflector and brought into contact with the metal-made support member, and there are a plurality of the ribs connecting the back face of the reflector and the connecting portion. Therefore, the heat of the LED is swiftly conducted to the LED support portion with which the back face of the LED board is brought into contact, and is conducted from the LED support portion to the reflector and the connecting portion integral therewith. Further, the heat conducted to the reflector is conducted to the connecting portion by way of the plurality of ribs, and is finally conducted to the metal-made support member with which the connecting portion is brought into contact. Further, a portion of the heat conducted to the plurality of ribs is discharged into air from the ribs.

According to one or more embodiments of the invention, the reflecting face of the reflector constitutes a paraboloid-like face a focal line of which is extended substantially in a horizontal direction, the LED support portion is aligned with the plurality of LEDs along a direction of extending the focal line. Therefore, light of LED is emitted efficiently to the front side, and further, the heat discharging performance is excellent.

Other aspects and advantages of the invention will be apparent from the following description and the appended claims.

DETAILED DESCRIPTION OF THE EXEMPLARY EMBODIMENTS

A vehicle lamp in accordance with embodiments of the invention will be explained in reference to the drawings below. Further, an illustrated embodiments may apply to a headlamp for an automobile.

Figure 1:
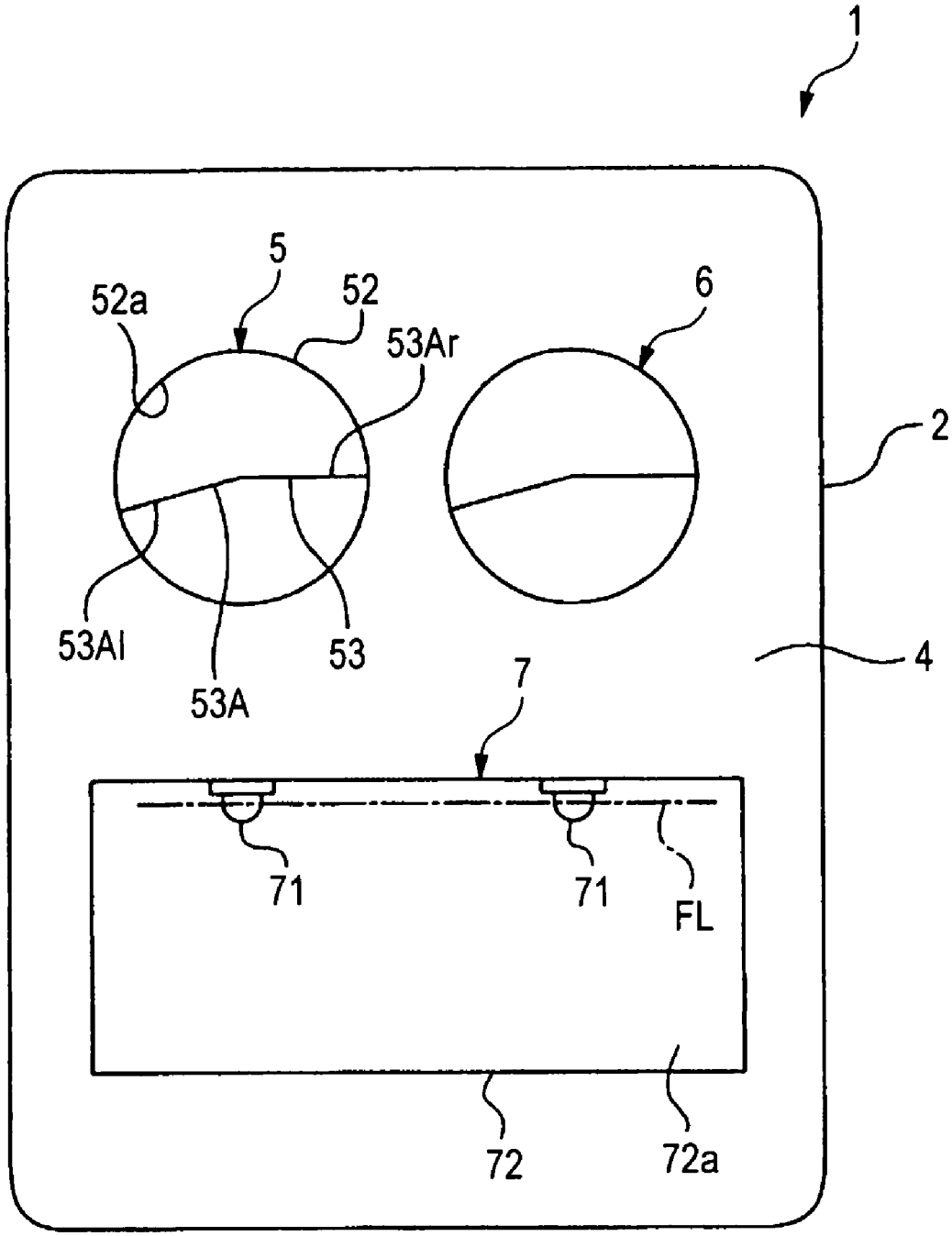
FIG. 1 shows an outline front view of a vehicle lamp in accordance with an embodiment of the invention showing a state of aligning LED units.

FIG. 1 is an outline front view of a vehicle lamp 1 showing the vehicle lamp 1 by removing a front face cover 3 covering a front face of a lamp body 2 and projecting lenses of respective LED units.

The lamp body 2 is constituted by a shape of a vessel having a front face that is open, and covered by the transparent front face cover 3. A plurality of LED units 5, 6, 7 are arranged inside of a lamp chamber 4 partitioned by the lamp body 2 and the front face cover 3.

The LED units 5, 6 are light emitting elements of a so-called projector type, and include LEDs as light sources, reflectors for converging light of the LEDs, and projecting lenses for projecting converged light of the LEDs to a front side.

Figure 2:
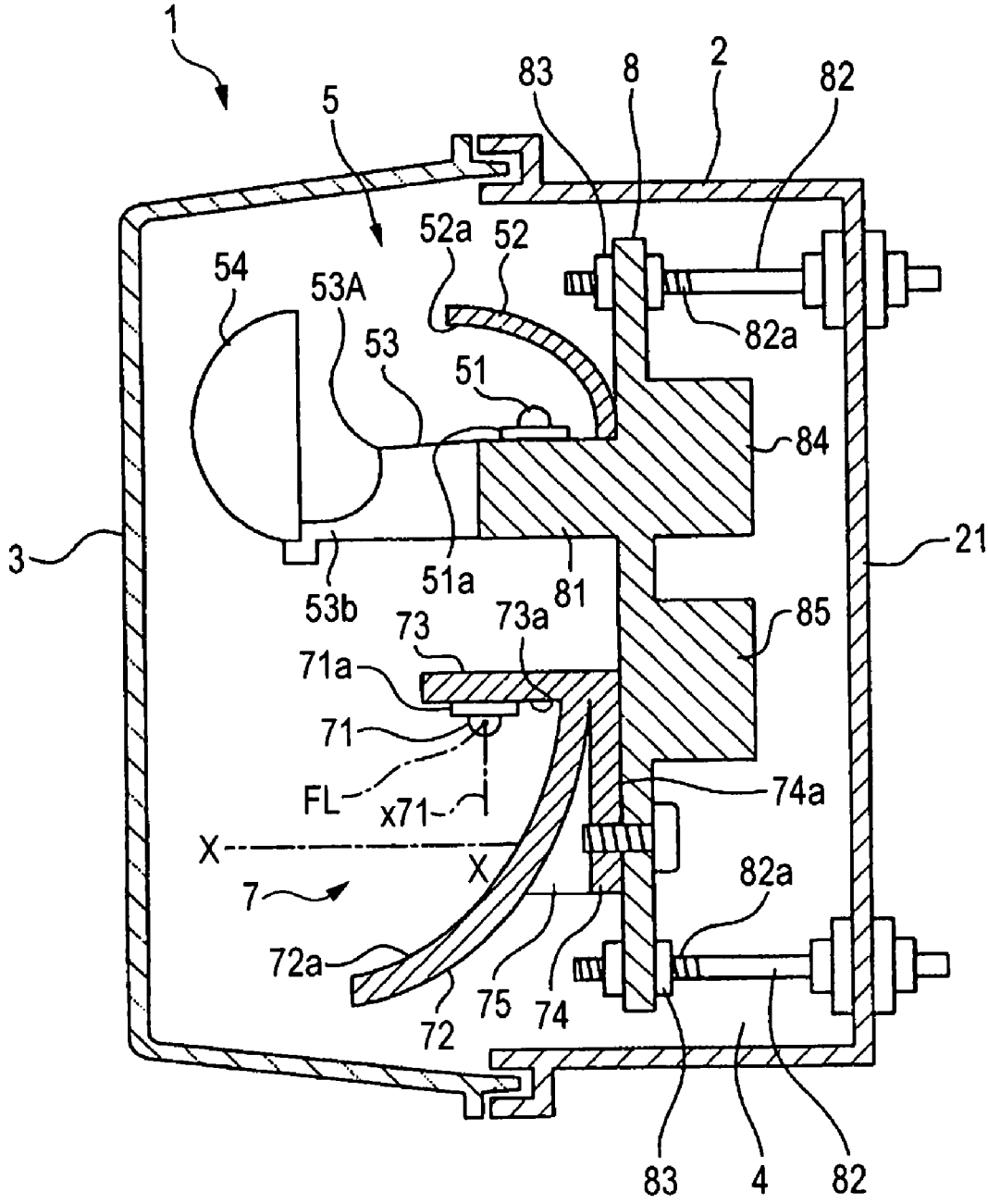
FIG. 2 is an outline sectional view of a vehicle lamp in accordance with an embodiment of the invention.
Figure 3:
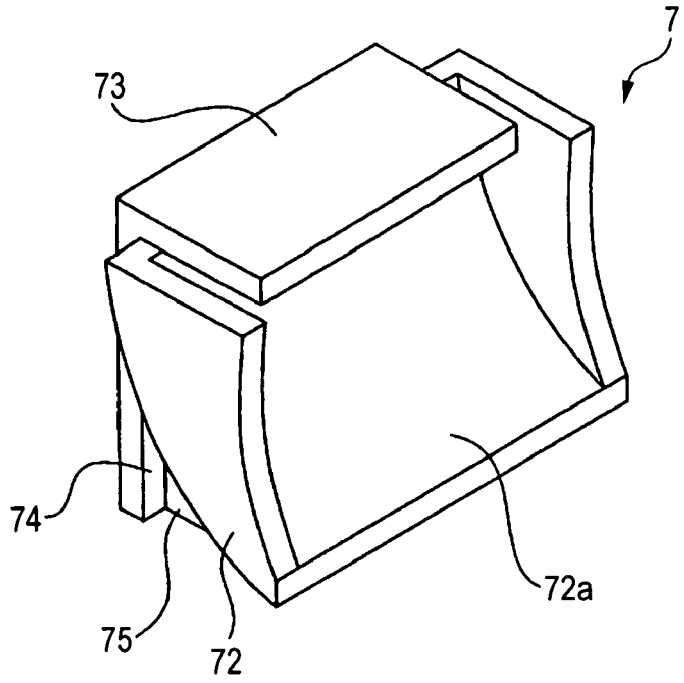
FIG. 3 is a perspective view of an LED unit.
Figure 4:
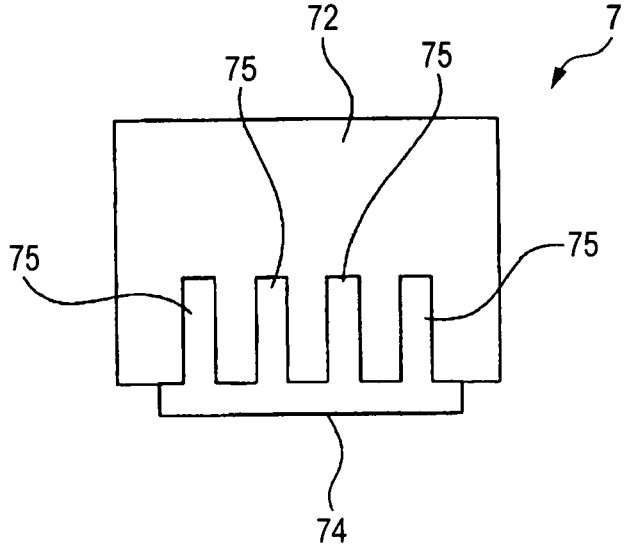
FIG. 4 is a bottom view of the LED unit.

The LED unit 5 is an LED unit for irradiating a pattern having a left skewed cutoff line and having a large spread in a left and right direction (hereinafter referred to as a "middle diffusing left light distribution unit"). As can be seen in FIG. 2, the LED unit 5 includes an LED 51 as a light source, and includes a reflector 52, a shade 53, and a projecting lens 54 as light control elements.

The reflector 52 is for converging light of the LED 51 and includes a reflecting face 52*a* by a shape of, for example, substantially an ellipsoid of revolution. The LED 51 is arranged at a first focal point position thereof. Therefore, light of the LED 51 is converged to a second focal point position of the reflector 52 having a slight width in the left and right direction. Further, the reflector 52 may converge light of the LED 51 to a desired position and a shape thereof is not limited to the paraboloid of revolution.

The projecting lens 54 is for projecting light of the LED 51 converged by the reflector 52 to the front side by inverting the light in an up and down direction and the left and right direction. The projecting lens 54 is constituted by a shape of a convex lens in which a rear face thereof, i.e., a face thereof on a side opposed to the reflector 52, is constituted by a flat face, and a front face thereof is constituted by a convex curve face (substantially spherical face). A rear side focal point thereof is disposed substantially at the second focal point of the reflector 52.

The shade 53 is for limiting an upper edge of an irradiated pattern. A limit edge 53A for limiting the upper edge of the pattern is disposed at the light converging region, i.e., substantially at the second focal point of the reflector 52. Further, a left side portion 53Al of the limit edge 53A in view from a center thereof (in view from a front side) is inclined in a left downward direction by an angle of about 15°, and a right side portion 53Ar in view therefrom is formed substantially horizontally.

Figure 5:
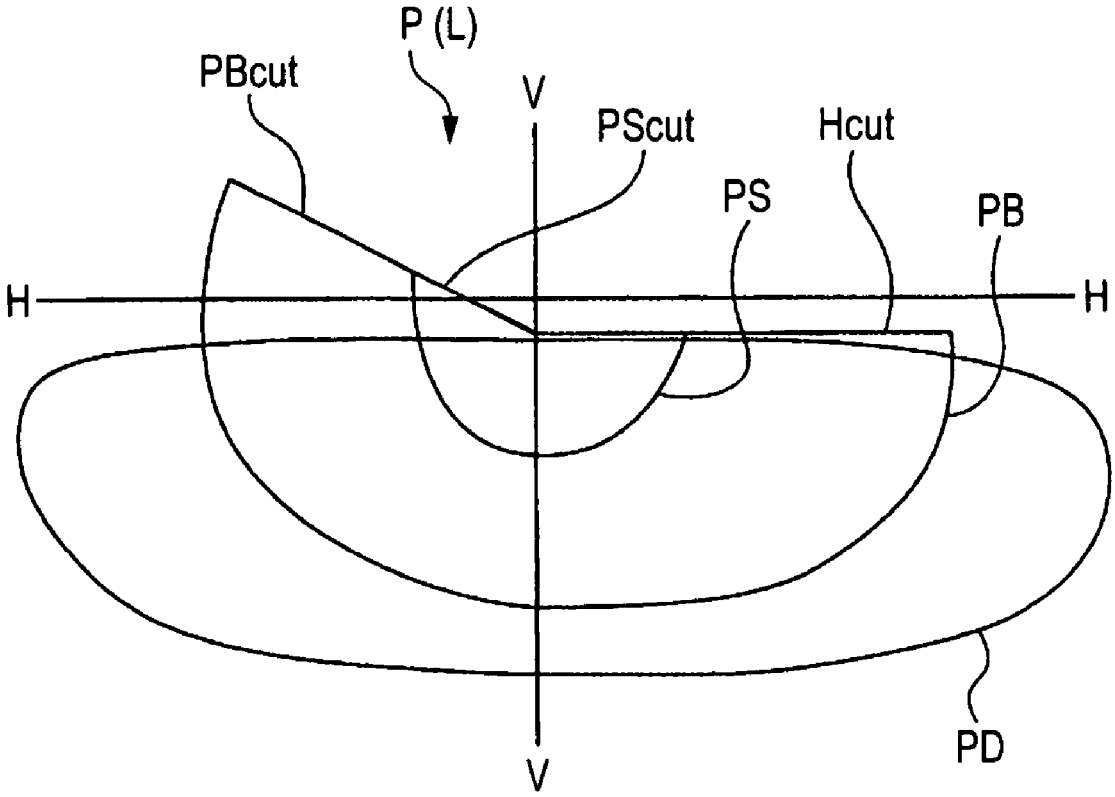
FIG. 5 is a view showing an example of a pattern of a beam irradiated by the vehicle lamp of an embodiment of the invention.

Therefore, according to the middle diffusing left light distribution unit 5, light of the LED 51 is converged to a portion at which the limit edge 53A of the shade 53 is disposed by the reflector 52 having a slight width in the left and right direction, and a portion of the converged light is blocked by the shade 53 to constitute a pattern a lower edge of which is limited by a shape of substantially a mountain in view from the front side. By invertedly projecting the pattern to the front side by the projecting lens 54, as shown by FIG. 5, there is irradiated a pattern PB having a cutoff line PBcut inclined in a left upward direction by an angle of about 15° on the left side and having a large spread in the left and right direction. Further, a horizontal cutoff line Hcut continuous to a right side of the cutoff line PBcut is disposed slightly on a lower side of the horizontal line H.

Further, FIG. 5 shows a light distribution pattern P (L) of a low beam formed by the vehicle lamp 1 on an imaginary vertical screen arranged at a position 25 m forward from the vehicle lamp 1. H line is a horizontal line having a height the same as that of the center of the vehicle lamp 1. V line is a vertical line passing a position the same as that of a center in the left and right direction of a vehicle mounted with the vehicle lamp 1.

Further, a metal-made support member 8 made by a metal, for example, as an aluminum diecast product, is supported by the lamp body 2 to be inclinable in the up and down direction and the left and right direction inside of the lamp chamber 4. That is, 3 pieces of adjusting shafts 82 (only 2 pieces thereof are shown in the drawing) are rotatably supported by a rear face wall 21 of the lamp body 2, and screwed shaft portions 82*a* formed at front half portions of the adjusting shafts 82 are screwed to nut members 83 supported by the metal-made support member 8. Therefore, when the adjusting shaft 82 is rotated, the screwed shaft portion 82*a* is screwed to or screwed from the nut member 83. Thereby, the nut member 83 is moved in a front and rear direction along the screwed shaft portion 82*a* of the adjusting shaft 82. That is, a portion supporting the nut member 83 of the metal-made support member 8 is moved in the front and rear direction. Therefore, a portion by which the nut member 83 screwed with the screwed shaft portion 82*a* of the adjusting shaft 82 operated to rotate is supported displaced in the front and rear direction relative to a portion by which the other nut member 83 is supported. Thereby, the metal-made support member 8 is inclined relative to the lamp body 2. Further, one of the portions connected to the lamp body 2 by 3 pieces of the adjusting shafts 82 of the metal-made support member 8 may be connected to the lamp body 2 by a pivoting fulcrum portion, or the metal-made support member 8 may inclinably be supported by the lamp body 2 by other support structure.

An LED board 51*a* mounted with the LED 51 is supported by an upper face of a light source arranging portion 81 integrally projected from a front face of the metal-made support member 8. A back face of the LED board 51*a*, i.e., a face thereof on a side opposed to the face mounted with the LED 51, is brought into contact with the upper face of the light source arranging portion 81. Further, the reflector 52 is supported on the light source arranging portion 81 to cover the LED 51 from an upper side.

The shade 53 is formed by a synthetic resin. The projecting lens 54 is supported by a front end portion of a support portion 53*b* projected to the front side from the front end portion. The shade 53 supporting the projecting lens 54 in this way is attached to the front end portion of the light source arranging portion 81. Thereby, the LED 51, the reflector 52, the limit edge 53A of the shade 53, and the projecting lens 54 are integrated by the above-described predetermined positional relationship.

The LED unit 6 is an LED unit for irradiating a pattern having a left skewed cutoff line and having a small spread in the left and right direction (hereinafter referred to as a "left light distribution unit"). The LED unit 6 is provided with a structure substantially the same as that of the LED unit 5. However, light of the LED is converged by an amount smaller than that of the LED unit 5 by a reflector 62. Therefore, as shown by FIG. 5, a pattern PS having a cutoff line PScut inclined in a left upper direction by an angle of about 15° on the left side is irradiated. Further, the horizontal cutoff line Hcut continuous to the right side of the cutoff line PScut is disposed slightly on the lower side of the horizontal line H.

The LED unit 6 is integrated to a light source arranging portion (not illustrated) projected to a right side in view from the light source arranging portion 81 of the front face of the metal-made support member 8 and the front side.

Further, heat discharge fins 84 are projected from positions of a rear face of the metal-made support member 8 in correspondence with the two light source arranging portions 81.

The LED unit 7 is a diffusing unit for irradiating a diffusing pattern.

The LED unit 7 includes 2 pieces of LEDs 71 and a reflector 72 arranged on a lower side of the LED 71. The reflector 72 includes a reflecting face 72*a* constituted by a paraboloid curve face having a focal line FL horizontally extended in the left and right direction. Further, 2 pieces of the LEDs 71 are arranged to be spaced apart from each other by a predetermined interval along the focal line FL.

Therefore, when the LED 71 of the LED unit 7 is lighted, light of the LED 71 is reflected by the reflector 72 to the front side along an emitting optical axis X-X of the LED unit 7. Further, because the reflector 72 includes a paraboloid reflecting face 72*a*, light reflected by the reflecting face 72*a* constitutes light of a pattern PD (refer to FIG. 5) constituting light substantially in parallel with regard to the up and down direction and considerably diffused in the left and right direction.

The LED unit 7 includes an LED support portion 73 for supporting the LED 71, the reflector 72, and a connecting portion 74 connected to the metal-made support member 8. The LED support portion 73, the reflector 72, and the connecting portion 74 are integrally formed as an aluminum diecast product.

The LED support portion 73 is formed in a shape of a plate a face direction of which is extended substantially in the horizontal direction, and is formed with two of mounting faces 73*a* in a shape of a flat face at a lower face thereof. The LED support portion 73 is integrally connected to an upper end portion of the connecting portion 74. Further, the LED 71 is supported by the LED support portion 73 such that the back face of the LED board 71*a* mounted with the LED 71, i.e., a face thereof on a side opposed to a face of mounting the LED 71, into face contact with the mounting face 73*a*. Therefore, the LED 71 is supported by the LED support portion 73 such that an optical axis x71, i.e., an emitting direction, is directed to the lower side.

The reflector 72 is constituted such that the reflecting face 72*a* is disposed to cover the front side in the irradiating direction of the LED 71 and light from the LED 71 is reflected to the front side of the LED unit 7.

The connecting portion 74 is extended substantially in the vertical direction to be disposed on the rear side of the reflector 72 and an upper end portion thereof is integrally connected with the upper end portion of the reflector 72. A rear face 74*a* constitutes a contact face brought into contact with the front face of the metal-made support member 8.

A plurality of ribs 75 are formed to align in the left and right direction to bridge the rear face of the reflector 72 and the front face of the connecting portion 74.

Therefore, when the LED 71 of the LED unit 7 is lighted, light of the LED 71 is reflected to the front side by the reflecting face 72*a* of the reflector 72. Further, because the reflector 72 includes the paraboloid reflecting face 72*a*, light reflected by the reflecting face 72*a* becomes light of the pattern PD constituting substantially parallel light with regard to the up and down direction and considerably diffused in the right direction.

Further, the LED unit 7 is attached to the metal-made support member 8 such that the rear face (contact face) 74*a* of the connecting portion 74 into contact with the front face of the metal-made support member 8. Further, the heat discharge fin 85 is formed at the rear face of the portion of the metal-made support member 8 attached with the connecting portion 74.

Further, the pattern PD is irradiated in a wide range widened in the left right direction, and therefore, a heat generation amount caused by lighting the LED 71 becomes considerable because the LED 71 has a large capacitance and a large light emitting amount is used. Alternatively, a plurality of the LEDs need to be used. However, in the LED unit 7, the LED support portion 73, the reflector 72, and the connecting portion 74 are formed integrally as the aluminum diecast product. Further, an interval between the reflector 72 and the connecting portion 74 is connected by the plurality of ribs 75. Therefore, the heat of the LED 71 is swiftly conducted to the LED support portion 73 with which the back face of the LED board 71*a* is brought into contact. Additionally, the heat is conducted from the LED support portion 73 to the metal-made support member 8 by way of the reflector 72 and the connecting portion 74, and is swiftly discharged. Further, heat conducted to the reflector 72 is conducted to the connecting portion 74 by way of the rib 75 projected from the back face of the reflector 72 and is discharged from the rib 75 into air (inside the lamp). Therefore, the heat of the LED 71 does not stay at the site of the LED, and it can be avoided that the temperature of the LED 71 is elevated by the heat of lighting the LED 71, which may lead to impairing the function thereof.

Further, because the reflector 72 and the connecting portion 74 are connected by the plurality of ribs 75, the reflector 72 and the connecting portion 74 are reinforced, and the shape stability is promoted. Also, the shape of the reflecting face 72*a* of the reflector 72 is accurately formed, and the desired light distribution function can be achieved.

In the vehicle lamp 1, when the LED units 5, 6, 7 are lighted, the patterns PB, PS, PD irradiated by the respective LED units 5, 6, 7 are synthesized and the low beam of the pattern P (L) shown in FIG. 5 is irradiated.

Although the above-described embodiments are examples applying to the headlamps for an automobile, these examples do not signify that the invention is limited to headlamps for an automobile. Those skilled in the art will appreciate that the range of lamps to which the invention is applicable, for example, a fog lamp, a bending lamp, or the like.

DESCRIPTION OF REFERENCE NUMERALS AND SIGNS

1 . . . vehicle lamp, 7 . . . LED unit, 71 . . . LED, 71*a* . . . LED board, 72 . . . reflector, 72*a* . . . reflecting face, 73 . . . LED support portion, 73*a* . . . mountuing face, 74 . . . connecting portion, 74*a* . . . contact face, 75 . . . rib, 8 . . . metal-made support member, X-X . . . emitting optical axis of LED unit, x71 . . . optical axis of LED While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle lamp comprising a light emitting diode (LED) unit comprising an LED supported by a metal support member;

wherein the LED unit is constituted by an integrally formed aluminum diecast product comprising:

an LED support portion for supporting the LED, a reflector comprising a reflecting face constituted by a face thereof opposed to the LED, a rib projected from a back face of the reflector, wherein the back face of the reflector is positioned on a side of the reflector opposite the reflecting face, and a connecting portion connected to the metal support member, wherein the connecting portion extends in a direction substantially perpendicular to a light emitting axis of the LED unit, and wherein the rib is disposed between the connecting portion and the reflector in a direction on the light emitting axis.

2. The vehicle lamp according to claim 1, wherein the reflecting face of the reflector constitutes a paraboloid-like face, a focal line of which is extended substantially in a horizontal direction; wherein the LED support portion is aligned with the plurality of LEDs along a direction of extending the focal line.

3. The vehicle lamp according to claim 1, wherein the reflecting face of the reflector constitutes a paraboloid-like face, a focal line of which is extended substantially in a horizontal direction; wherein the LED support portion is aligned with the plurality of LEDs along a direction of extending the focal line.

4. The vehicle lamp according to claim 1, wherein the LED support portion includes a mounting face, the LED is mounted on a front face of a LED board, the LED board includes a back face which is opposed to the front face, and the rib is substantially perpendicular to the mounting face.

5. A vehicle lamp comprising a light emitting diode (LED) unit comprising an LED supported by a metal support member;

the LED unit comprising:

an LED support portion adapted to support an LED;

a reflector comprising a reflecting face adapted to reflect light emitted by the LED, a rib projected from a back face of the reflector, wherein the back face of the reflector is positioned on a side of the reflector opposite the reflecting face, and a connecting portion adapted to connect to the metal support member wherein the connecting portion extends in a direction substantially perpendicular to a light emitting axis of the LED unit, and wherein the rib is disposed between the connecting portion and the reflector in a direction on the light emitting axis.

6. The vehicle lamp according to claim 5, wherein the LED support portion includes a mounting face, the LED is mounted on a front face of a LED board, the LED board includes a back face which is opposed to the front face, and the rib is substantially perpendicular to the mounting face.

7. The vehicle lamp according to claim 5, wherein the LED unit is integrally formed as aluminum diecast product.

8. The vehicle lamp according to claim 5, wherein the LED support portion comprises a mounting face adapted to support an LED board mounted with the LED in a direction in which an optical axis of the LED becomes orthogonal to the light emitting axis of the LED unit, and contact a back face of the LED board.

9. The vehicle lamp according to claim 5, wherein the reflecting face of the reflector covers a front side in an irradiating direction of the LED, and reflects light from the LED to a front side of the LED unit.

10. The vehicle lamp according to claim 5, wherein the connecting portion comprises a contact face extended substantially in a vertical direction adapted to be disposed on a back side of the reflector, and contact the metal support member.

* * * * *